US006497406B1

(12) United States Patent
Moore et al.

(10) Patent No.: US 6,497,406 B1
(45) Date of Patent: Dec. 24, 2002

(54) QUIET JOGGING

(75) Inventors: Michael J. Moore, Bloomfield Hills, MI (US); Michael N. Tranquilla, Livonia, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 09/145,777

(22) Filed: Aug. 27, 1998

Related U.S. Application Data

(60) Provisional application No. 60/058,032, filed on Sep. 2, 1997.

(51) Int. Cl.[7] ..... B65H 3/62; B65H 31/38

(52) U.S. Cl. ..... 271/146; 271/210

(58) Field of Search ..... 271/221, 145, 271/146, 241, 210

(56) References Cited

U.S. PATENT DOCUMENTS 703,271 A * 6/1902 Jelf ..... 271/221
1,236,892 A * 8/1917 Wilson ..... 271/221
2,277,511 A * 3/1942 Daneke ..... 271/221
2,396,822 A * 3/1946 Brisendine ..... 271/221
2,494,075 A * 1/1950 Weyandt ..... 271/221
2,624,577 A * 1/1953 Peugnet ..... 271/221
3,198,519 A * 8/1965 Bartsch ..... 270/221
3,223,410 A * 12/1965 Wilson et al. ..... 271/221
3,835,955 A * 9/1974 Harkness
4,403,686 A * 9/1983 Rycenga
4,407,403 A * 10/1983 Wadensten
5,842,916 A * 12/1998 Gerrity et al.

* cited by examiner

*Primary Examiner*—Donald P. Walsh
*Assistant Examiner*—Brett C Martin
(74) *Attorney, Agent, or Firm*—David G. Rasmussen; Mark T. Starr; Lise A. Rode

(57) ABSTRACT

A document jogger jogs unit records such as checks and like value documents. The jogger has a bin for receiving the documents, and a vibrator coupled to the bin to vibrate it. A liner is adapted to be removably attached to the bin. The liner has an impact absorbing flexible material attached to the liner to absorb the shock of the documents as the bin is vibrated. A thin abrasion resistant, low friction layer covers the flexible material to prevent documents from damaging the flexible material and allows the documents to slide easily. The thin abrasion resistant, low friction layer is also soft enough to permit the flexible material to absorb the shock of said documents.

15 Claims, 5 Drawing Sheets

QUIET JOGGING

This is a Continuation of our U.S. Provisional Ser. No. 60/058,032 filed Sep. 2, 1997 and claims priority therefrom.

This relates to machine processing of checks and like unit records, and especially to "jogging" operations therefor.

BACKGROUND, FEATURES

Workers in the document processing arts (e.g., machine processing of checks) know that it is common to subject stacks of such unit-record documents to a "jogging" operation where the documents are confined and shaken on a flat surface (e.g., jogging table) to help align their leading edges.

FIG. 1 gives an idealized upper perspective of a jogger tray T which, includes a see-through storage area S and is adapted to receive stacks of standard-size documents (e.g., checks 5–10" long X 2.25–4.5" high) in various pockets (e.g., four like pockets shown: I,II,III,IV) which may each be roughly as long as a check-length. Tray T will be understood as to be mounted on a mechanical jogger (or shaker) means JB' adapted to tilt the in-tray check stacks down toward their "leading-edges" and shake them sufficient to quickly align the leading and bottom edge of all checks in a stack. Tray T will generally comprise a flat base or deck d and four like walls (front, back, side) with separators for each pocket.

After the requisite shaking (jogging) and when such alignment is complete, a single stack of checks can be picked up from each pocket and injected into an automatic check processor machine (not shown, but well known in the art). Here, for simplicity one might assume that the checks are 6 inches long by 2¾ inches high, though this is not required.

A noise problem can develop during most jogging. We find that objectionable acoustic noise of document joggers can be ameliorated or eliminated by an insert lined with impact absorbing material which is protected from damage by a thin, abrasion resistant coating. The insert can be easily replaced with minimal downtime and cost if the lining is accidentally damaged or the coating eventually wears out.

Thus, an object hereof is to allow document processing equipment operators to jog documents for long periods of time without objectionable acoustic noise. (Long jog times enhance document processing performance).

What is New or Different: Impact absorbing materials here specified are long wearing and will withstand abuse because of the thin coating. Yet, the thin coating will not substantially reduce the vibration dampening effectiveness of the underlying material. The liner design permits easy replacement if extreme abuse (e.g.; puncture from scissors or staple) damages it.

Advantages Over Past Practice: Operators will jog longer because objectionable acoustic noise is absent. Abrasion resistant coating prevents early wear of impact absorbing material. Replaceable liner reduces downtime. Liner design eliminates crevices where document edges can lodge, preventing effective jogging. The invention is also apt for use to jog other like unit records, e.g. in mail sorters, or envelope stuffing machines. Thus, quieter record jogging is an object hereof.

Thus, an object hereof is to address and resolve at least some of these problems and provide at least some of the here-described features. A particular object is to jog items more quietly. A more particular object is to add impact-absorbing, noise-suppressing material as a liner in a record-jogging bin.

Other objects and advantages of the present invention will be apparent to those skilled in the art.

BRIEF DESCRIPTION OF THE DRAWINGS

The foregoing and other features and advantages of the present invention will be appreciated by workers as they become better understood by reference to the following detailed description of the present preferred embodiments, these being considered in conjunction with the accompanying drawings, wherein like reference symbols denote like elements:

FIG. 1 is a very schematic, idealized showing of a check-jogger tray mounted for jogging; while

FIG. 2A gives a side view of a jog bin, while

DETAILS

Figure 1:
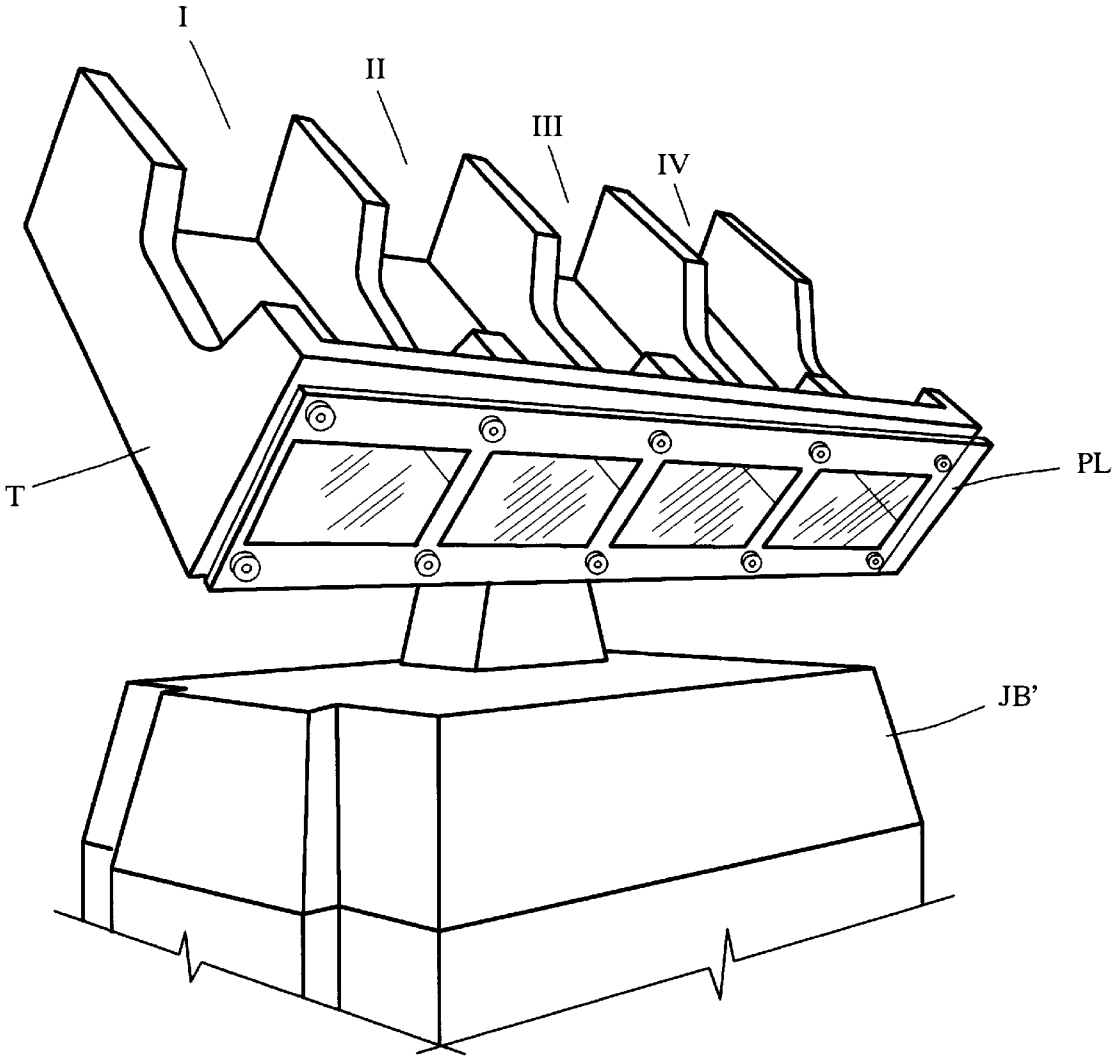
Figure 1A:
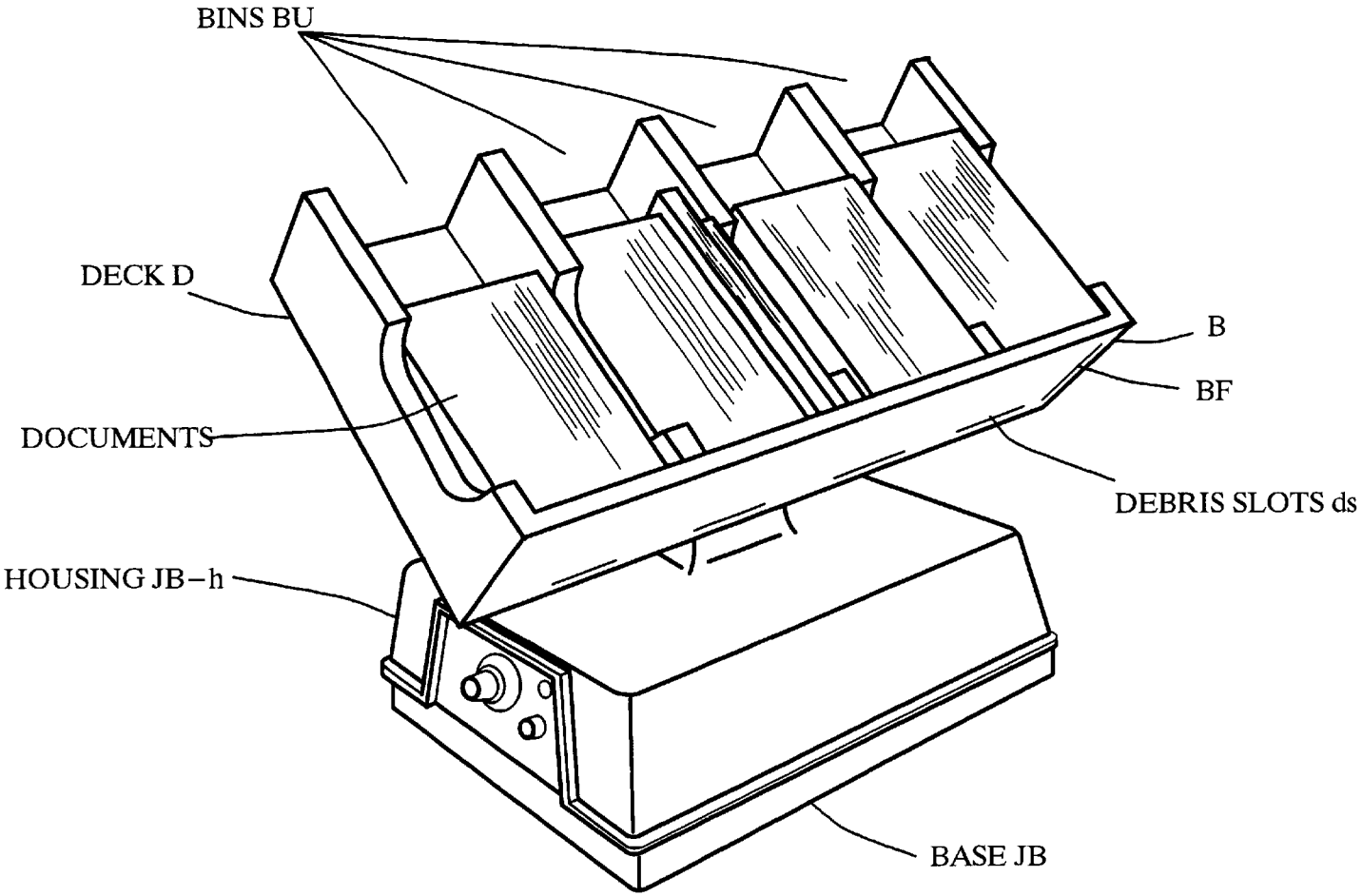
FIG. 1A is a like showing of a jogger bin modified according to an embodiment of the invention (but without any noise-suppressing liner)

FIGS. 1, 1A illustrate a document jogger, without provision for acoustic noise treatment. The jogger's main function is to line-up all the leading and bottom edges of a stack of documents so they can be reliably operated upon by document processors. This is accomplished by vigorously vibrating the stack of documents in a bin unit BU so that their interdocument friction lock is broken and they fall to the bottom of the bin.

The base JB is usually a very heavy part with rubber feet underneath it. The rubber feet rest on a table or special stand so that the deck is at a convenient height for an operator to load and unload documents in the bins. The housing is suspended from the base with springs. An electromagnet rigidly fastened to the base excites the housing with an alternating magnetic field. This field causes the housing to vibrate on its suspension vertically. A deck, usually a hard, solid wood such as maple, is rigidly fastened to the housing so that it vibrates with the housing. The amplitude of this vibration is approximately 0.050 inch peak-to-peak, and its frequency is usually common household frequency, 60 Hertz.

Figure 2A:
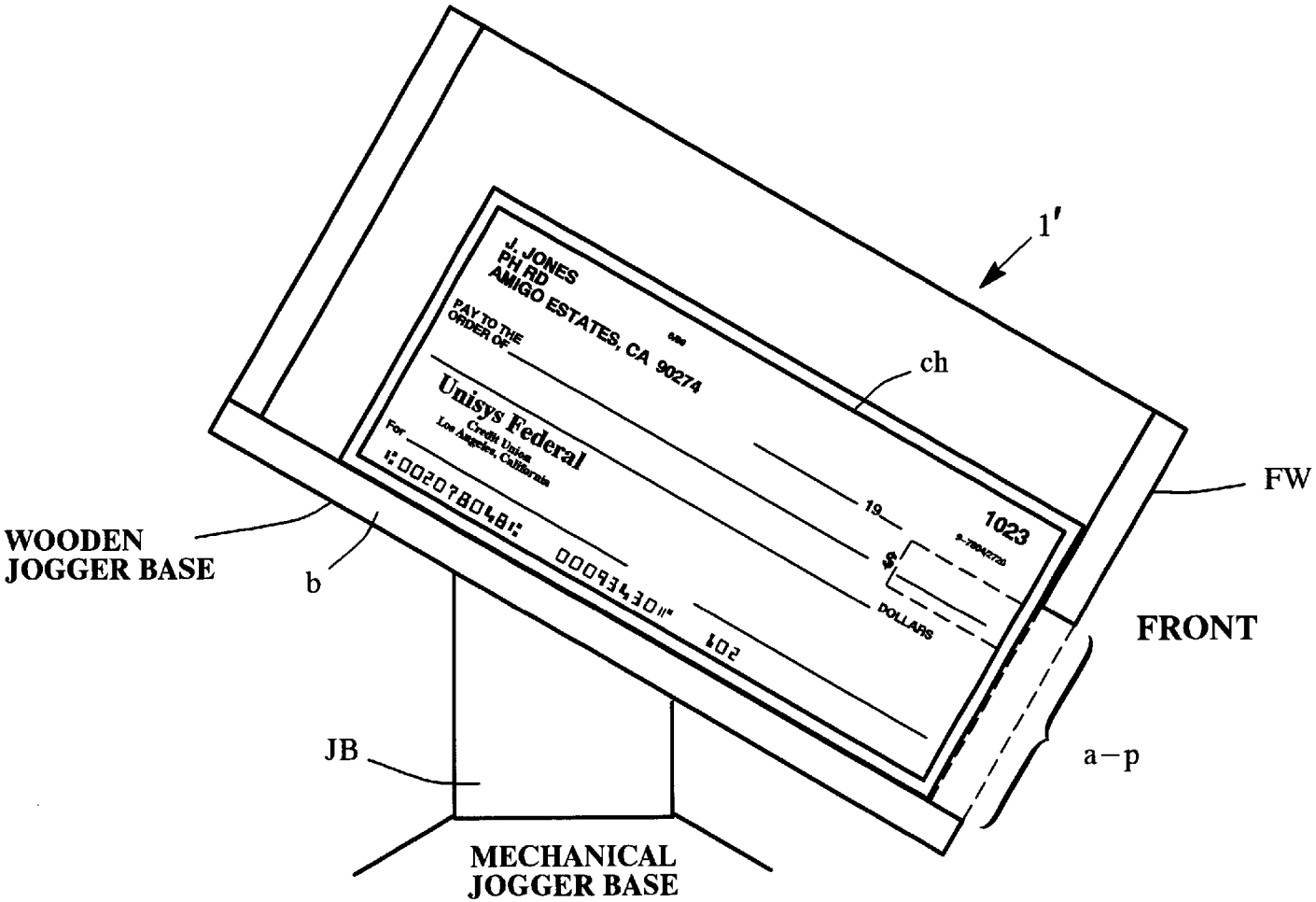

The deck D of BU is divided into bins b of a convenient size: normally to hold a stack of documents that can be grasped in one adult human hand. A jogger may have one or more bins, b, depending upon the jogging time and number of documents being processed. As many as 12 bins have been employed, but 4 bins (as in FIGS. 1, 1A) is common for use with check processing equipment. To facilitate lining up both the leading and bottom edges of the documents, the deck D and front bin walls Bf form a vee. Documents settle into this vee because of the vertical vibration of the deck (e.g. such is illustrated in FIG. 2A).

Bits of paper, staples, rubber bands, or paper clips may dislodge from the documents because of the vigorous vibration. Debris slots ds near the bottom of the vee allow these items to fall out of the bins.

The above will be well understood by those familiar with the state of the art of document joggers. With current technology, the documents bounce within the bins. The impact of the documents' leading and bottom edges against the hard wooden deck produces vibration in the deck which then emanates objectionable acoustic noise. One solution to this acoustic problem involves cushioning the impact by lining the deck with soft foam bonded to the vee surfaces of each bin. However, documents are abrasive, and they can readily wear grooves into this foam. Also, the foam can be easily torn by staples, etc. Such "wear-grooves" and tears can interfere with effective jogging: e.g. by preventing leading and bottom edges from lining-up properly. Replacing the foam normally requires replacing the entire deck—an expensive proposition.

Embodiment Details

Figure 2B:
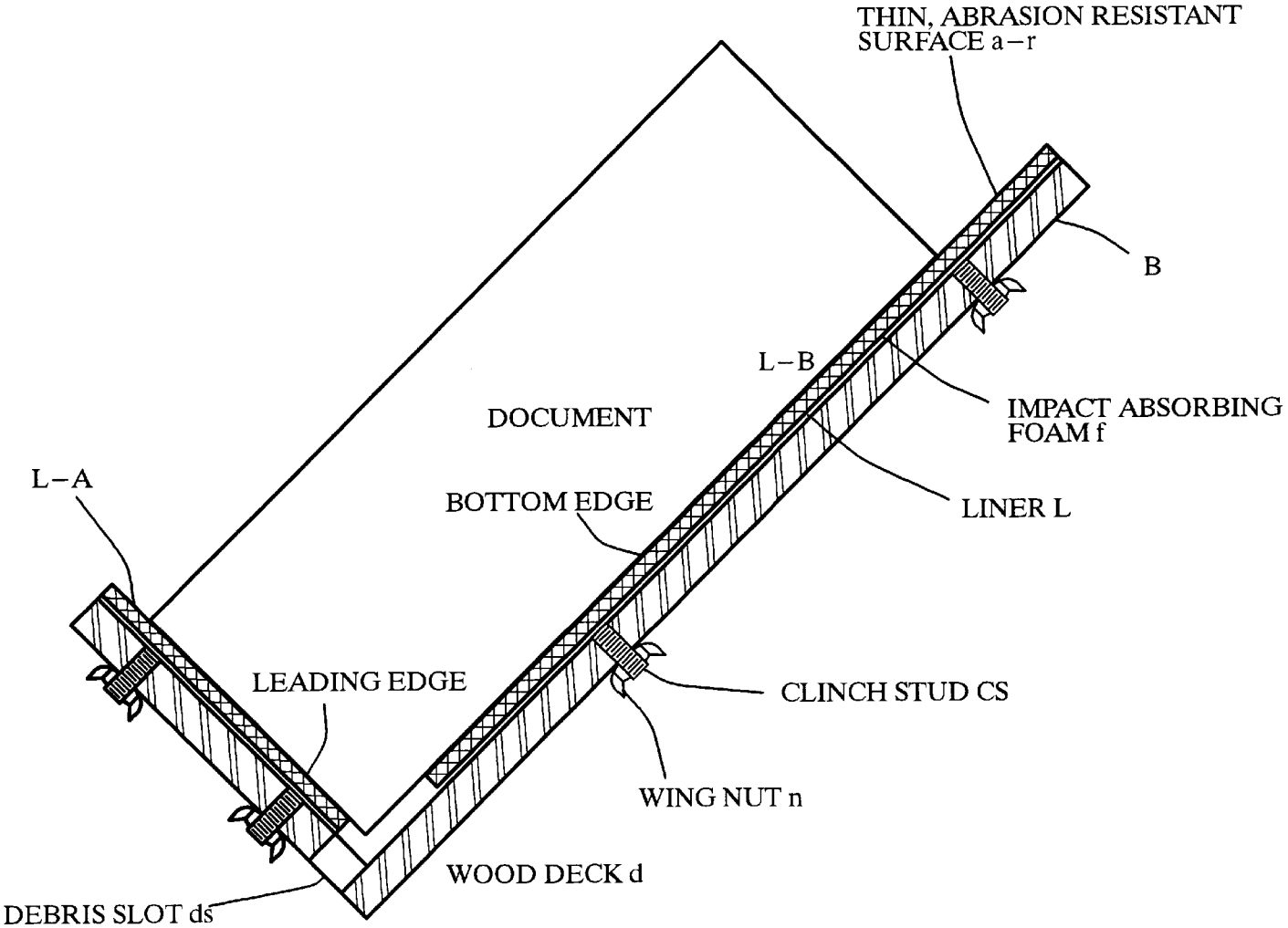
FIG. 2B shows a bin with surfaces covered according to a preferred embodiment.
Figure 3:
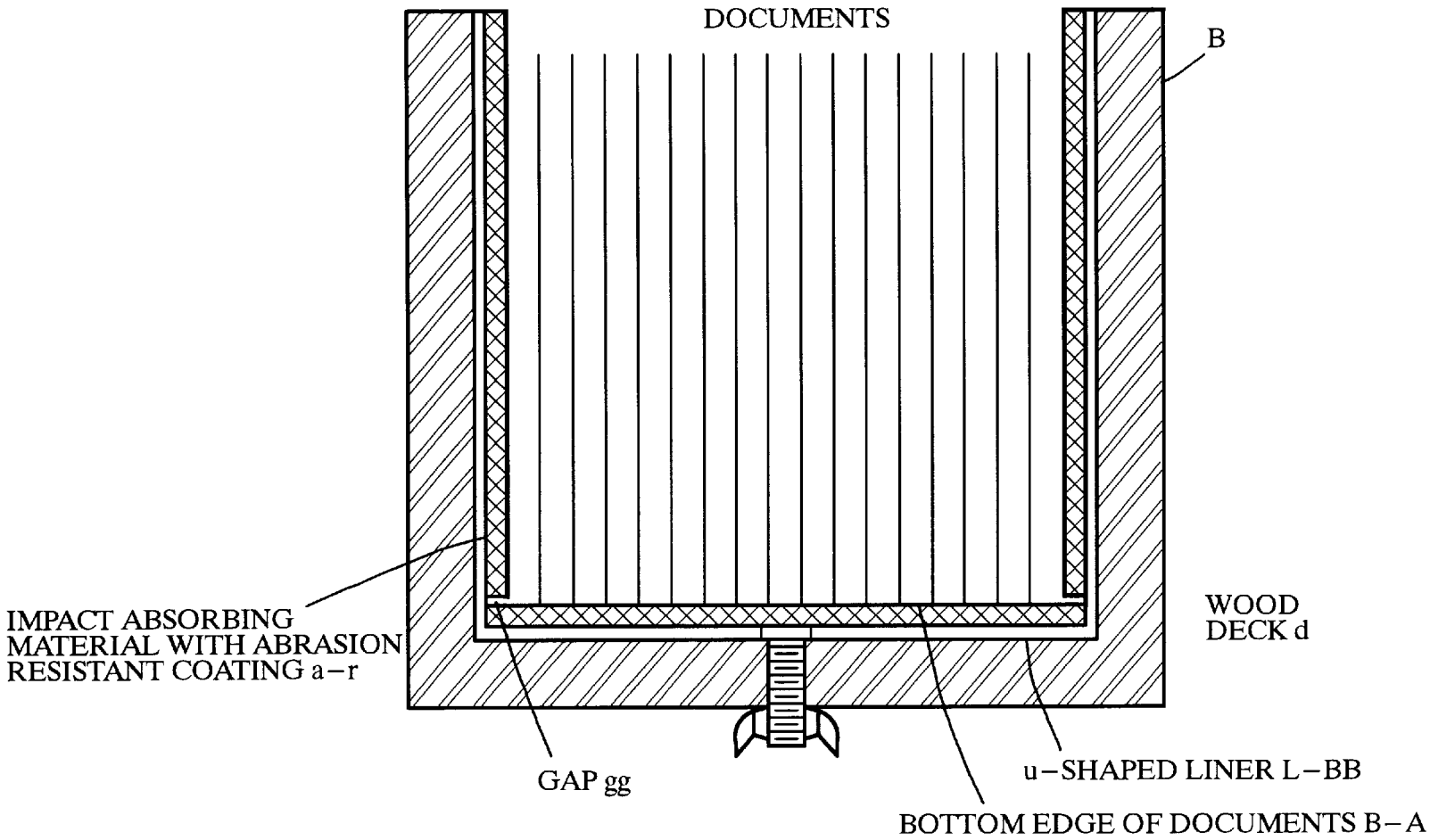
FIG. 3 gives a front view.

A preferred embodiment is depicted in FIGS. 1A, 2B, 3 where a 4-pocket check-jogger B' is modified, according to the invention, to include bin-liner material to suppress noise—thereby allowing records (e.g. checks) to be jogged at high speeds, vigorously and for long periods without excess noise or wear.

FIG. 2B is a section of a bin B' viewed perpendicular to the document face. Impact absorbing material f, such as foam or soft rubber, is bonded to a liner L using commonly known adhesive or vulcanization techniques. Preferably, the thickness of the impact absorbing material f is approximately 0.125 inch. The liner L can be metal, plastic, or any other material which can hold fasteners such as clinch stud cs, secured by wing nuts n—these used to attach the liner L to the deck d. A characteristic such a fastener—according to the invention—is that no part of it should protrude beyond the liner on the impact absorbing material side and into the area of the document where it may contact the documents' leading edges (this could interfere with jogging). Another characteristic is that such fasteners should not be so pushed into the impact absorbing material as to, reduce its impact-absorbing properties, or forming a "bump" on the document contact surface which would interfere with aligning documents'edges. Commonly known fasteners such as clinch studs or weld studs, for example, can meet these requirements.

The clinch stud threaded fasteners c-s or the like protrude through holes in the wood deck d. Any nuts n which can be manually torqued to hold the clinch nuts to the wood deck can be used. Examples are wing nuts or knobs with threaded holes. This permits the liner/absorbing material assembly to be easily removed and replaced without tools or need for a skilled operator. Thus, each assembly can be replaced quickly and easily, if it is accidentally damaged, minimizing document processor down time.

A thin (approximately 0.005 inch thick) abrasion resistant coating a-r (FIG. 3) may also be formed on the impact absorbing material f to prevent document edges from abrading and damaging its surface. The coating material a-r should also, preferably be flexible enough to permit the impact absorbing material to absorb vibrational energy (e.g. from a bouncing document). Additionally, the coating material a-r should have low friction against paper documents to permit the documents to slide easily into registration. In contrast, foam or soft rubber surfaces will usually present high friction against document papers. Coating materials such as ultra high molecular weight polyethylene are preferred (but not limited to this material) to provide the abrasion resistance, the flexibility, and the low friction.

The liner L preferably is composed of two pieces: a document leading edge absorbing assembly L-A, and a document bottom edge absorbing assembly L-B (FIG. 2B). Each can be independently installed and removed. The bottom edge assembly L-B is preferably separated sufficiently from the leading edge assembly L-A so as to continue to permit debris to pass through the wood deck's debris slots ds, as is shown in FIG. 2B.

The document bottom edge absorbing assembly L-B preferably comprises a U shaped liner L-BB, as shown by the crossectional view in FIG. 3. The U shape permits an assembly that prevents the document edges from being exposed to small crevices (approximately the thickness of a document; e.g. 0.004–0.010 inch thick paper is common), where the document will be trapped, and therefore, will not jog properly. The liner LBB should be formed with a very small radius, but consistent with good forming practices. The vertical walls of the U shape are lined with the same impact absorbing material as is used to cushion document edges, but with a sufficiently large gap gg (approximately 0.050 inch) between them and the bottom edge impact absorber to separate the documents from the crevices formed by the bottom edge absorber and the vertical liner walls. It also absorbs impacts due to slapping the document against the side walls of the bin while jogging.

Results

It will be apparent that our aforedescribed invention is apt for effecting the objects mentioned; e.g., reduce noise from jogging documents in a bin.

It will be evident that this noise-suppression is preferably effected by providing inner bin surfaces with a liner means comprising a foam layer or the like, with wear-resistant, flexible coating on its inner face and a flexible liner on its opposite face, with fasteners removably coupling the foam and liner to the bin.

Of course, modifications to the preferred embodiment described are possible without departing from the spirit of the present invention. For example, there are other different ways to provide such noise-suppressing foam and Liners, and the invention is not limited to the particular types of receptacles, joggers or the particular types of documents or tapes described. Additionally, some features of the present invention can be used to advantage without the corresponding use of other features.

What is claimed is:

1. A document jogger for jogging documents, the document jogger comprising:

a bin for receiving said documents;

a vibrator coupled to said bin for vibrating said bin;

a liner for said bin adapted to be removably attached from said bin;

an impact absorbing flexible material attached to said liner, said flexible material being of a softness to absorb the shock of said documents as said bin is vibrated; and a thin, abrasion resistant, low friction layer covering said flexible material to prevent documents from damaging said flexible material and allowing said documents to slide easily, said thin abrasion resistant, low friction layer also soft enough to permit said flexible material to absorb the shock of said documents to quiet said document jogger.

2. The document jogger of claim 1 wherein said thin, abrasion resistant, low friction layer is made of ultra high molecular weight polyethylene.

3. The document jogger of claim 1 wherein said bin comprises a first surface being adapted to support bottom edges of the documents and a second surface disposed normal to said first surface and being adapted to support leading edges of the documents.

4. The document jogger of claim 3 where said first and second surfaces define a uniform crack-gap therebetween that is large enough to pass extraneous record accessory parts.

5. The document jogger of claim 3 where each surface is covered by said liner with said flexible material interposed thereupon.

6. The document jogger of claim 1 wherein said bin is received in a cradle affixed on said vibrator.

7. The document jogger of claim 1 wherein said bin is subdivided to receive various groups of documents.

8. The document jogger of claim 3 wherein the surfaces define a debris-passing slot therebetween.

9. Apparatus for jogging like documents, the apparatus comprising:

means for receiving and storing said documents;

said storing means having first and second flat surfaces disposed perpendicular to one another to form a v-configuration;

means for vibrating said storing means;

means, attached to said surfaces, for suppressing noise, said noise suppressing means comprising means for absorbing impact of the documents, the impact absorbing means having a softness sufficient to absorb a shock of said documents during vibrations and including associated liner means adapted to be removably attached to said first and second surfaces; and a thin, abrasion resistant, low friction layer covering said impact absorbing means to prevent documents from damaging said impact absorbing means and allowing said documents to slide easily, said low friction layer also being sufficiently flexible to permit said impact absorbing means to absorb the shock of said documents.

10. The apparatus of claim 9 wherein said flat surfaces provide a first, bottom-edge-supporting surface and a second, leading-edge-supporting surface disposed normal to said first bottom-edge-supporing surface.

11. The apparatus of claim 9 wherein said first and second flat surfaces define a uniform gap therebetween that is large enough to pass extraneous document accessory parts.

12. The apparatus of claim 9 wherein each surface is covered by said liner means with said impact absorbing means interposed thereupon.

13. The apparatus of claim 9 wherein said receiving and storing means is received in a cradle affixed on said vibrating means.

14. The apparatus of claim 9 wherein said storing means is sub-divided to receive various groups of documents.

15. The apparatus of claim 9 wherein the surfaces define a debris passing slot therebetween.

* * * * *